US005647077A

United States Patent [19]

Abe et al.

[11] Patent Number: 5,647,077

[45] Date of Patent: Jul. 15, 1997

[54] WATER MATTRESS APPARATUS AND A WATER BAG USED FOR THE WATER MATTRESS APPARATUS

[75] Inventors: Takeo Abe, Akigawa; Shoji Kawamura, Oume, both of Japan

[73] Assignee: France Bed Co., Ltd., Tokyo, Japan

[21] Appl. No.: 454,242

[22] PCT Filed: Oct. 13, 1994

[86] PCT No.: PCT/JP94/01713

§ 371 Date: Jun. 12, 1995

§ 102(e) Date: Jun. 12, 1995

[87] PCT Pub. No.: WO95/10210

PCT Pub. Date: Apr. 20, 1995

[30] Foreign Application Priority Data

| | | | |
|---|---|---|---|
| Oct. 15, 1993 | [JP] | Japan | 6-055822 U |
| Apr. 8, 1994 | [JP] | Japan | 6-070805 |
| Apr. 8, 1994 | [JP] | Japan | 6-070806 |
| Apr. 26, 1994 | [JP] | Japan | 6-088569 |

[51] Int. Cl.[6] ..... A47C 27/10

[52] U.S. Cl. ..... 5/685; 5/682; 5/422

[58] Field of Search ..... 5/422, 450, 451, 5/452, 455, 457, 458, 470, 449

[56] References Cited

U.S. PATENT DOCUMENTS

| | | | |
|---|---|---|---|
| 4,141,770 | 2/1979 | Mollura | 5/458 X |
| 4,208,748 | 6/1980 | Lobach | 5/457 X |
| 4,221,013 | 9/1980 | Echevarria | 5/455 X |
| 4,280,235 | 7/1981 | Kowal | 5/932 X |
| 4,602,396 | 7/1986 | Fraige | 5/451 |
| 4,737,998 | 4/1988 | Johnson, Sr. | 5/455 |
| 4,798,936 | 1/1989 | Johnson, Sr. | 5/422 X |
| 4,912,789 | 4/1990 | Maxwell | 5/451 X |
| 5,490,295 | 2/1996 | Boyd | 5/457 X |
| 5,513,401 | 5/1996 | Abe et al. | 5/470 |

FOREIGN PATENT DOCUMENTS

| | | |
|---|---|---|
| 59-8599 | 3/1984 | Japan . |
| 59-37079 | 10/1984 | Japan . |
| 2-26555 | 2/1990 | Japan . |
| 4-62727 | 10/1992 | Japan . |

*Primary Examiner*—Michael F. Trettel

*Attorney, Agent, or Firm*—Frishauf, Holtz, Goodman Langer & Chick

[57] ABSTRACT

A cushion unit is provided which is elastically compression-deformable on load. A case is stacked on the upper surface of the cushion unit. The case has an upper surface and lower surface with a receiving section open relative to the upper surface. A water bag is formed of a flexible water-proof sheet and containing a liquid. The stacked cushion unit and case are covered with an outer layer unit.

14 Claims, 7 Drawing Sheets

WATER MATTRESS APPARATUS AND A WATER BAG USED FOR THE WATER MATTRESS APPARATUS

TECHNICAL FIELD

The present invention relates to a water mattress apparatus having a water bag containing a liquid therein and a water bag for use in the water mattress apparatus.

BACKGROUND ART

There are various types of known mattress apparatuses. Of these, a water mattress apparatus is known. The water mattress apparatus has a water bag containing a liquid therein and, on load, the liquid contained in the water bag is displaced along the uneven contour of the body of a user on the water mattress apparatus in a supine position. Since, in this case, there occurs no reaction force which may be produced from the strength corresponding to that amount of compression, such as that of a mattress apparatus composed of a spring unit, no great compression force acts upon any heavy body portion of the user, such as the buttocks.

Unless the user is forced to have his or her body partially and strongly compressed, such a mattress apparatus can be used for, for example, an ill or elderly person confined to bed over a long period of time, thus preventing any bed sores upon him or her. In recent years, the water mattress apparatus has been extensively utilized in view of its advantage to which attention is paid.

The water mattress apparatus described above, usually, has a case with a water bag held in its receiving section. The case with the water bag so held is covered with an outer cover unit comprised of a cloth sewed into a bag-like unit.

The liquid contained in the water bag is non-compressive in nature during moving in a deformed water bag on application of load. For this reason, the water mattress apparatus with the water bag held in the case imparts no cushioning action resulting from a varying elastic compression to the user on load, thus failing to give any comfortable cushioning action to the user as is obtained from the spring mattress.

The liquid contained in the water bag has its temperature lowered considerably in the winter season. To this end, a heater is arranged in the case for holding the water bag and the liquid in the water bag is warmed by the heater to a temperature at which the mattress apparatus is comfortable to sleep on.

It is said that about 33°±1° C. is usually a temperature at which the user can comfortably sleep on the mattress apparatus. It is also said that the user can readily fall asleep at a temperature about 3° C. higher at his or her feet than at the remaining portions of the body. There are sometimes the case where, since, in particular, a person unduly sensitive to cold is usually about 3° C. lower at his or her feet than at the remaining body portions, he or she cannot enjoy a comfortable sleep unless the feet are more warmed than the rest of his or her body.

The water bag is formed of an elastic, water-proof sheet-like material, such as rubber or vinyl. When the water bag is pierced by something sharp, abruptly impacted or damaged due to degeneration over prolonged use, etc., the liquid sometimes leaks from the water bag into the receiving section of the case.

In order to prevent the liquid which flows out of the water bag from leaking outside via the receiving section of the case, a water-proof bottom sheet is usually laid on the receiving section of the case. Simply laying such a bottom sheet on the receiving section sometimes may cause the liquid which leaks via the receiving section to be absorbed by the outer cover unit so that it oozes out of the outer cover unit.

From this view point, it has been considered to cover the top-opened side of the receiving section with a water-proof upper sheet. If, therefore, the top-opened side of the receiving section is so covered with the upper sheet, it is possible to prevent the liquid which leaks via the receiving section from being absorbed.

There is, however, a possibility that, if such an upper sheet is provided between the case and the outer cover unit, the sweat from the user on the outer cover unit in a supine position as well as a moisture content from an outer atmosphere will be accumulated over an upper area of the upper sheet.

Since the upper sheet is placed in contact with the water bag, the temperature of the upper sheet is low. For this reason, the moisture content in contact with the upper sheet is produced in the form of dew on an outer surface and a considerable amount of dew is sometimes accumulated over a prolonged period of use. In such a case, however, moisture is absorbed in the outer cover unit on the upper surface side of the upper sheet and an accumulated water content may sometime ooze out on the outer cover unit. Further, the outer cover unit tends to be readily moistened, thus giving an unpleasant feeling to the user, allowing ready multiplication of germs there and providing a cause of a bad odor.

The water bag is formed of an elastic sheet such as rubber and vinyl. If, therefore, a load is exerted on the water bag, a liquid moves in the water bag, causing it to be expanded and deformed. In order to restrict the deformation of the water bag, therefore, a plurality of band-like partition members are provided therein at given intervals. That is, the partition member is fixed at one width-direction end to an inner upper surface of the water bag and at the other end to an inner lower surface. Even if, therefore, any load is exerted on the water bag, its expansion is restricted by the partition members, thus decreasing a deformation amount to a small extent.

When an impact load is exerted on the water bag by, for example, the jumping of the user onto the mattress apparatus, then the impact is applied to the fixing area between the water bag and the partition bag, thus involving a possibility of the water bag being torn open under that impact force and of the inner liquid leaking out of the water bag.

DISCLOSURE OF THE INVENTION

An object of the present invention is to provide a water mattress apparatus which has a cushioning function of elastically supporting a user.

Another object of the present invention is to provide a water mattress apparatus which can warm the feet of a user at a temperature higher than the remaining portion of the user's body.

Another object of the present invention is to provide a water mattress apparatus which can prevent a liquid which leaks from a water bag into a case from flowing out.

Another object of the present invention is to provide a water mattress apparatus which can prevent a moisture content from being deposited at an outer layer unit even in the case where an upper sheet is provided so as to prevent a liquid which leaks out of a water bag from being absorbed into the outer layer unit.

Another object of the present invention is to provide a water bag which, in the case where partition members are provided for restricting a deformation of the water bag, can prevent a liquid from leaking out of the water bag even when the water bag is torn due to a great impact load being exerted thereon.

In one preferred embodiment illustrating a first aspect of the present invention, a water mattress apparatus comprises a cushion unit which is subjected to elastic compressive deformation on load; a case having an upper surface and lower surface with a receiving section opened relative to the upper surface of the case and joined at the lower surface to an upper surface of the cushion unit in a stacked relation; a water bag formed from a flexible water-proof sheet and held in the receiving section with a liquid contained in the water bag; and an outer layer unit covering the stacked cushion and case.

According to a second aspect of the present invention, as set out in a water mattress apparatus a case having an upper surface and lower surface with a receiving section opened relative to the upper surface of the case; a plurality of water bags formed from a flexible water-proof sheet with a liquid contained therein and held in the receiving section of the case in a manner to be arranged side by side along a predetermined direction; heaters provided in the case and adapted to warm the liquids of the water bags; temperature control means for effecting control in a way to make a temperature in the liquid of the water bag which is mounted on one end side of the receiving section in a predetermined direction higher than a temperature in the liquid of the other water bags; and an outer layer unit covering a stacked unit of said cushion unit and case.

According to a third aspect of the present invention, a water mattress apparatus comprises a case having an upper surface and lower surface with a receiving section opened relative to the upper surface; a water bag formed from a flexible water-proof sheet with a liquid contained therein and held in the receiving section of the case; internal liquid absorbing means, provided in the receiving section, for absorbing a liquid leaking from the water bag into the receiving section of the case; a water-proof sheet so provided as to cover the upper surface side of the case and preventing the liquid from flowing out of the water bag; and an outer layer unit covering the case.

According to a fourth aspect of the present invention, a water bag containing a liquid therein an inner bag formed of a flexible water-proof sheet and containing the liquid therein to provide a liquid-tight structure; an outer bag formed of a flexible water-proof sheet and containing the inner bag therein to provide a liquid-tight structure; and a liquid absorbing member provided between the inner bag and the outer bag to allow absorption of the liquid leaking out of the inner bag.

According to a fifth aspect of the present invention, a water bag comprises a bag formed of a flexible water-proof sheet and containing a liquid therein to provide a liquid-tight structure; and partition members comprised of an upper sheet fixed at one end to an inner upper surface of the bag and a lower sheet fixed at one end to an inner lower surface of the bag and at the other end to the other end of the upper sheet in which the strength of fixing is so set to be lower at the other end sides of the sheets than at the one end sides of the sheets.

According to the water mattress apparatus of the first aspect of the present invention, the case is supported by the cushion unit so that the user can be given a cushioning action on a cushion unit.

According to the water mattress apparatus of the second aspect of the present invention, the liquid in the water bag of those separate water bags, that is, the liquid in the water bag situated in the "feet" side of the user, can be warmed to a temperature higher than the liquids in the remaining bags.

According to the water mattress apparatus of the third aspect of the present invention the liquid leaking from the water bag into the receiving section of the case is absorbed by the internal liquid absorbing means provided there so that the liquid is prevented from flowing out from the case.

According to the water bag of the fourth aspect of the present invention, the inner and outer bags are provided as a double-layered structure, whereby the inner bag with the liquid contained therein is less subject to a break and, even if the inner bag is damaged, the liquid in the broken bag is absorbed by the liquid absorbing member and there is less possibility that the liquid will leak.

According to the water bag of the fifth aspect of the present invention, when a great impact force is exerted on the bag, the partition member comprised of the upper and lower sheets so acts that the fixing area of the inner and outer sheets is broken earlier than the fixing area of the respective sheet and the bag and the bag can be prevented from being broken and the liquid therein can be prevented from leaking.

BEST MODE OF CARRYING OUT THE INVENTION

The embodiments of the present invention will be explained below with reference to the accompanying drawings.

Figure 1:
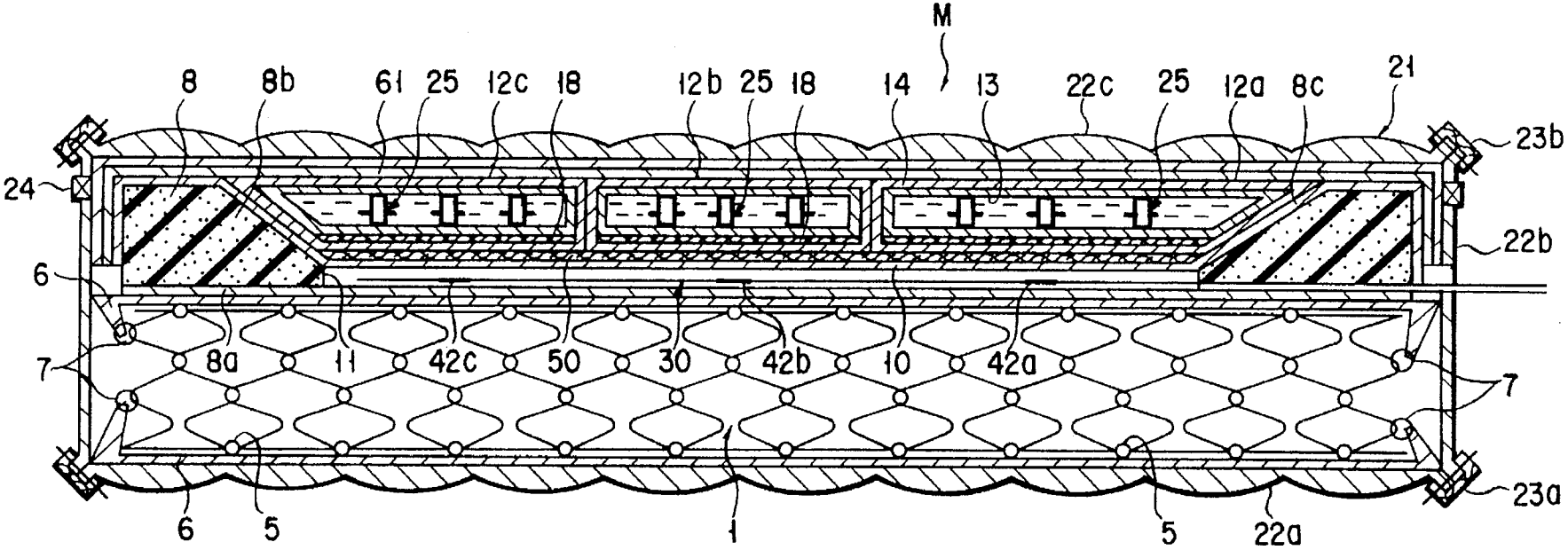
FIG. 1 is a longitudinal cross-section showing a mattress apparatus according to a first embodiment of the apparatus of the present invention.
Figure 2:
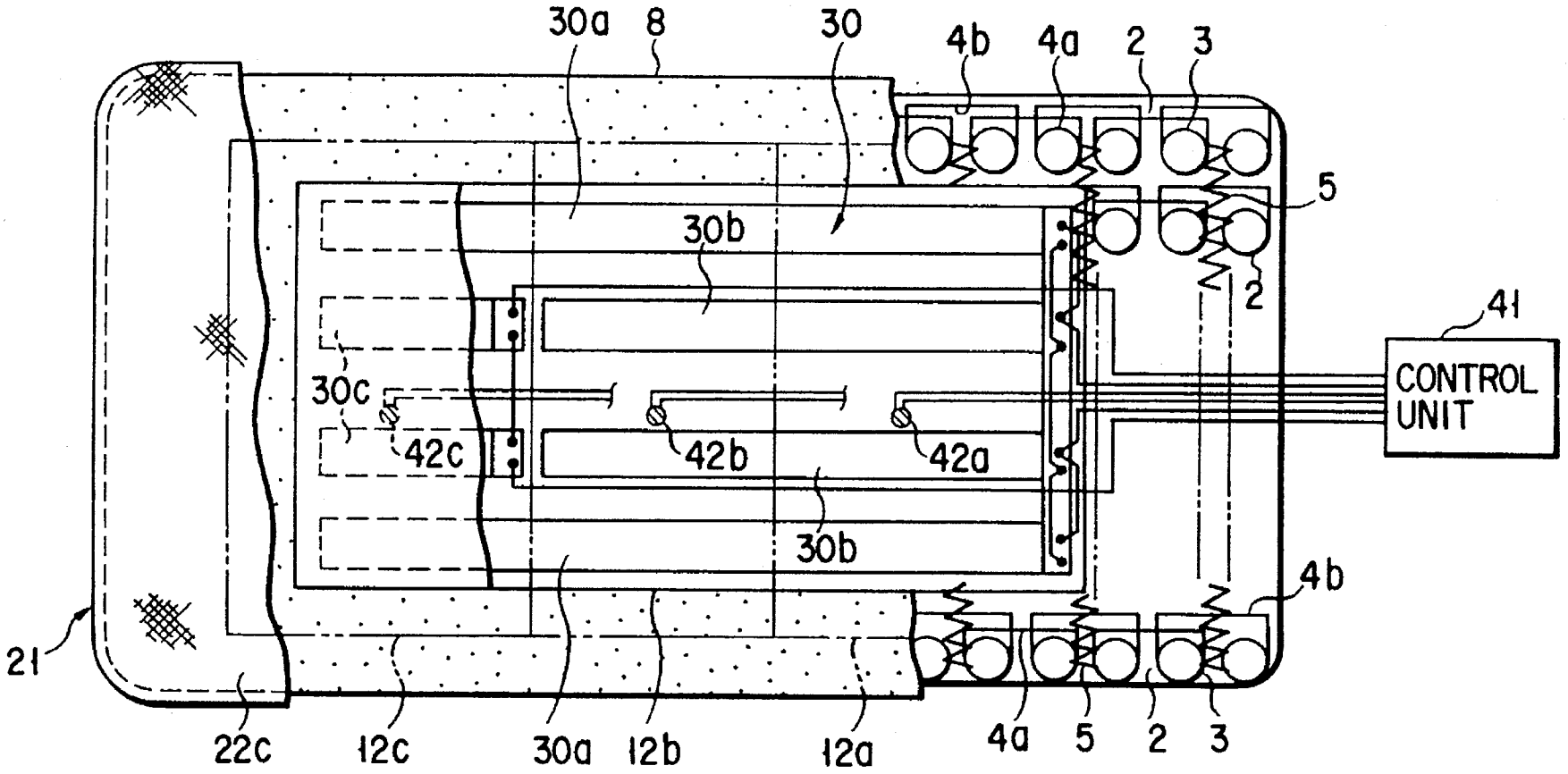
FIG. 2 is a plan view, partly in cross-section, showing the apparatus.

FIGS. 1 to 7 show a first embodiment of the present invention. A water mattress apparatus M as shown in FIG. 1 is equipped with a spring unit 1 as a rectangular-shaped cushioning body of a given thickness. The spring unit 1 is comprised of continuous springs 2 provided along its width direction as shown in FIG. 2.

Figure 7:
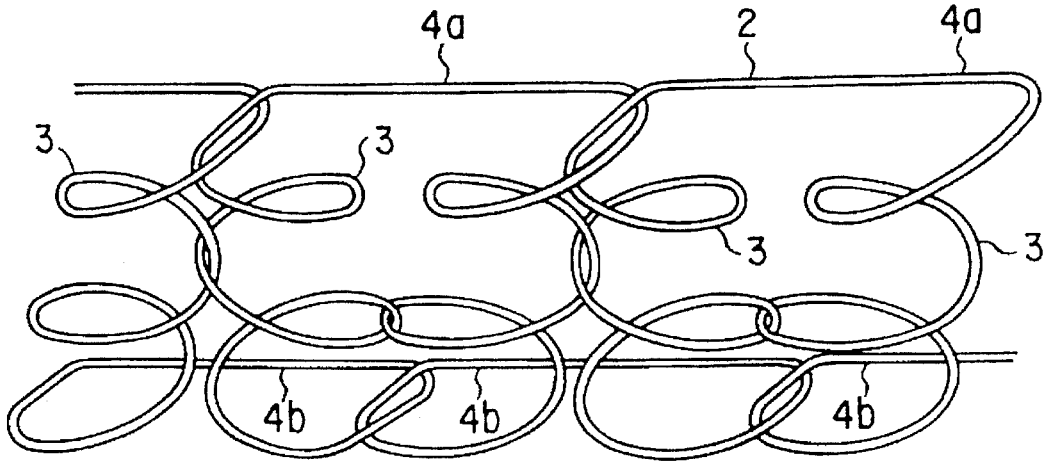
FIG. 7 is a perspective view showing a continuous spring for a spring unit in the apparatus.

The continuous spring 2 is comprised of a single length of a wire having a plurality of coil portions bent in one array as shown in FIG. 7. The upper and lower end portions of the adjacent coil portions are made continuous with upper and lower U-shaped rod-like connection portions 4*a* and 4*b*, respectively. The upper and lower rod-like connection sections 4*a* and 4*b* are so formed as to have their pitches displaced relative to each other in a longitudinal direction of the continuous spring 2. The coil portion 3 has its intermediate portion entwined around those of the adjacent coil portions 3.

As shown in FIG. 2, the continuous springs 2 are arranged in a juxtaposed relation with helical wires 5 connected thereto. That is, the helical coil 5 is coiled around the upper and lower end portions 3 of the continuous spring 2, that is, around the side portions of the adjacent upper rod-like connection portions 4*a* and around the sides of the adjacent lower rod-like connection portions of the continuous wire.

A protective sheet 6, made up of felt, is provided around the top side and bottom side of the spring unit 1 as shown in FIG. 1 and fixed by clips 7 at the top and bottom sides of the spring unit 1.

Figure 4:
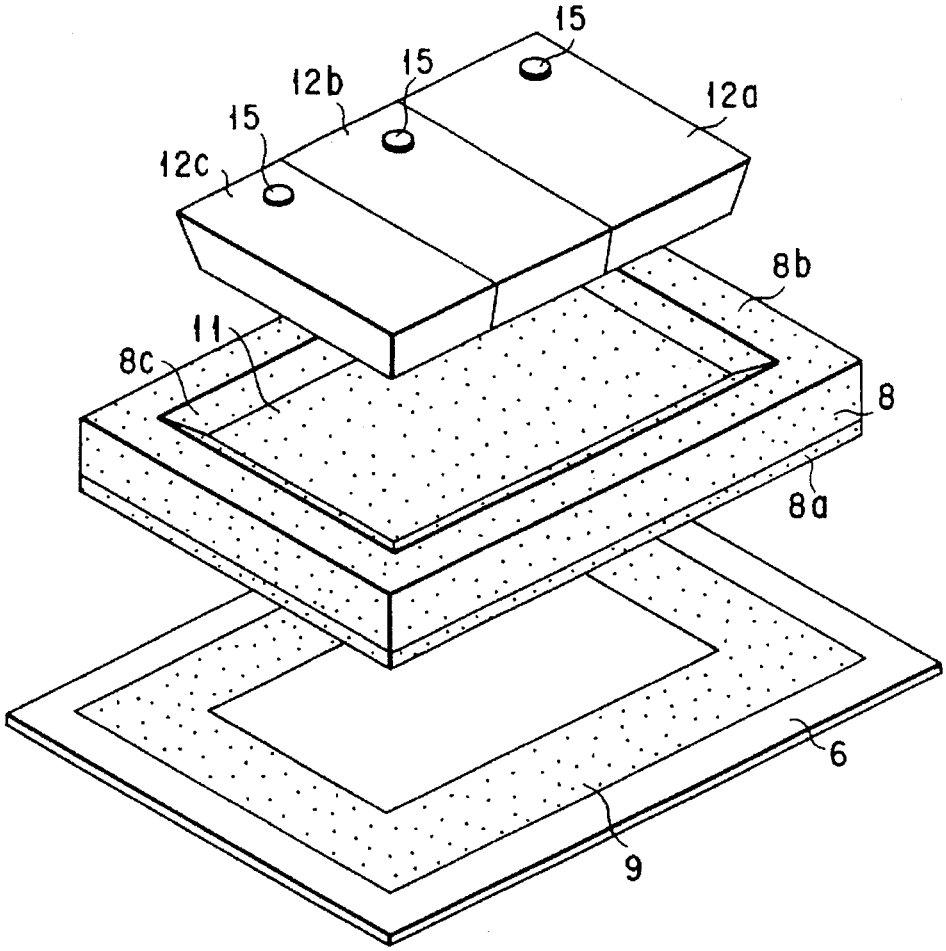
FIG. 4 is an exploded perspective view showing a protective sheet, case and water bag in the apparatus.

A case 8 has its bottom surface adhesively bonded in a stacked way to the protective sheet 6 on the top side of the spring unit 1. That is, an adhesive layer 9 formed of a bonding agent is attached to the upper surface of the protective sheet 6 as shown in FIG. 4 and the lower surface of the case 8 is adhesively fixed to the adhesive layer 9 of the protective sheet 6, thereby preventing the case 8 from being displaced over the spring unit 1.

The case 8 comprises a base plate 8*a* of a semi-rigid elastic material, such as urethane foam, having an elasticity and breathability and containing a mildew- and germ-proof agent and a urethane foam body equal in nature to, or somewhat more pliable than, the base plate 8*a*. The base plate 8*a* is formed integral with a frame section 8*b* provided at the upper marginal area of the base plate 8*a*.

By doing so, the case 8 is open at the top side to provide a receiving section surrounded by the frame section 8*b*. An inclined surface 8*c* is provided around the inner surrounding area of the frame section 8*b* such that it is inclined toward the inside of the frame section.

A planar-array heater unit 30 as shown in FIG. 2 is provided on the bottom of the receiving section 11 of the case 8. As shown in FIG. 1, a bottom sheet 10 comprised of a water-proof synthetic resin sheet covers the upper surface of the planar-array heater unit 30 and inclined surface, top surface and outer peripheral surface of the case 8.

Figure 5:
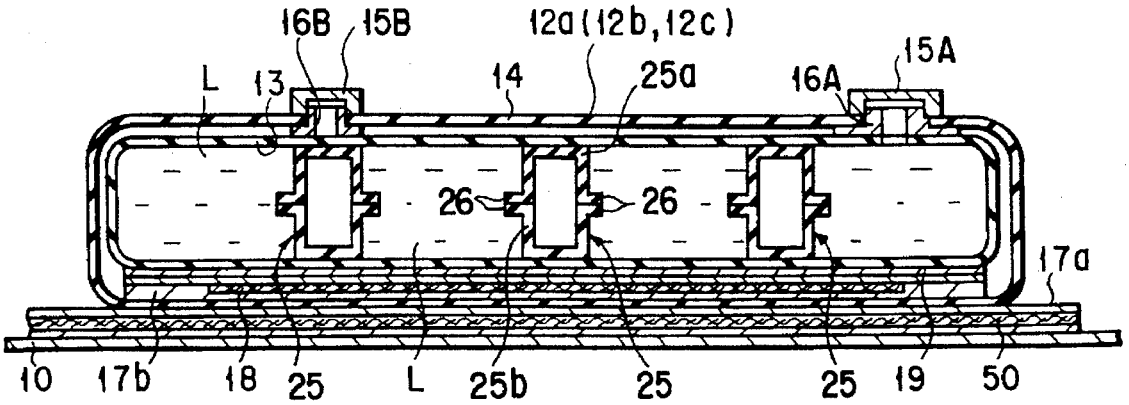
FIG. 5 is a cross-sectional view showing a water bag and first and second internal liquid absorbing sheets provided on the lower surface side of the water bag.

A first internal liquid absorbing member 50 held in a bag 17*a* is provided on the upper surface of the bottom sheet 10 in the receiving section 11 as shown in FIGS. 1 and 5 and made of a material for absorbing a liquid as will be described below. The bag 17*a* is formed of a liquid-permeable material, such as a non-woven fabric.

On the upper surface of the first internal liquid absorbing member 50, first, second and third water bags 12*a* to 12*c* flat-like in configuration are arranged in a side-by-side manner along the longitudinal direction of the mattress apparatus M. The water bags 12*a* to 12*c*, each, provide a double-bag structure, as shown in FIG. 5, having an inner bag 13 formed of a flexible water-proof sheet, such as pliable rubber, and an outer bag 14 receiving the inner bag 13 therein.

First and second plugs 16A and 16B are provided as projected plugs at the upper surface of the outer bag 14, the first plug 16A communicating with the inner bag 13 and being opened and closed by a first cap 15A and the second plug 16B communicating with space between the outer bag 14 and the inner bag 13 and being opened and closed by a second cap 15B. Via the first plug 16A, a liquid L, such as water and gel, can be supplied into, or discharged from, the inner bag 13 and the second plug 16B can vent air accumulated in the space between the outer bag 14 and the inner bag 13.

Figure 6:
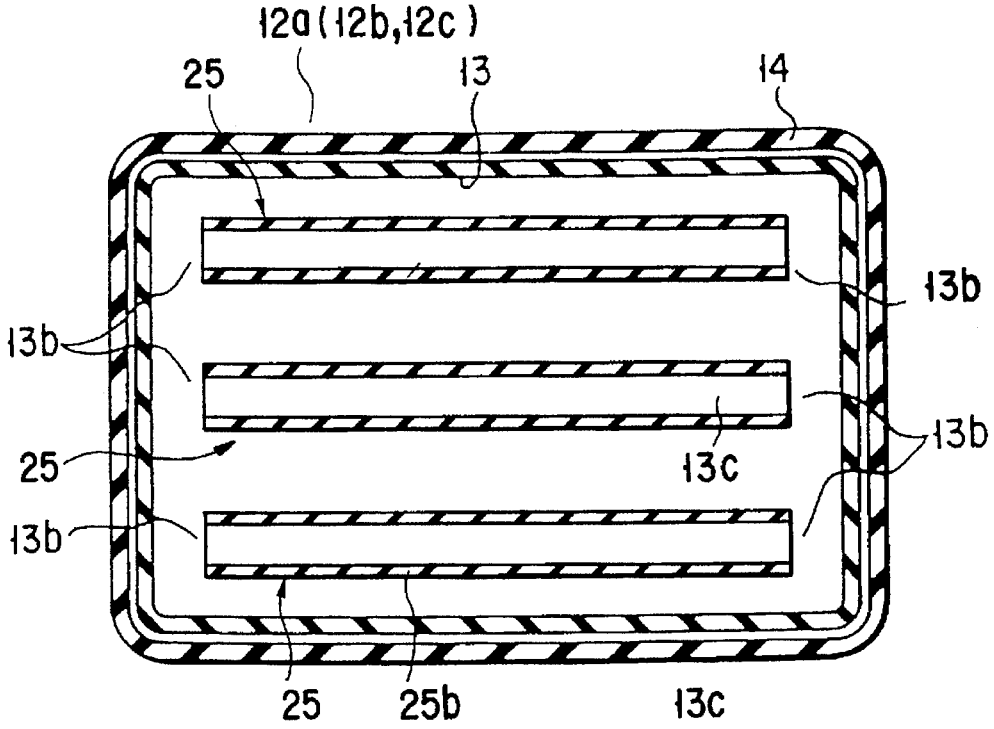
FIG. 6 is a lateral cross-sectional view showing an interior of a water bag in the apparatus.

Within the inner bag 13 a plurality of partition members 25 are arranged at predetermined intervals along a width direction of the inner bag as shown in FIG. 6 in such a manner as to be fixed to the inner top and bottom surfaces of the inner bag 13. That is, the partition member 25 is divided into an upper sheet 25*a* fixed at one end to the inner top surface of the inner bag 13 and a lower sheet 25*b* fixed at one end to the inner bottom surface of the inner bag 13.

The sheets 25*a* and 25*b* are comprised of synthetic resin sheets of a given width dimension with their intermediate portions U-bent so that the U-bent intermediate portions are fixed as the one-end sides to the inner top and bottom surfaces of the inner bag 13.

The other-end sides of the respective sheets 25*a* and 25*b*, that is, both width-direction ends of the respective sheets, are bent into L-shaped ends to provide flanges 26 with the pair of upper and lower sheets 25*a* and 25*b* joined at those flanges.

Joining the one-end sides of the sheets 25*a* and 25*b* to the inner bag 13 and joining together the opposed joints at the other-end sides of these sheets are achieved by thermal welding and bonding agent, noting that the strength of joining at the other-end sides (at flanges 26) is set to be lower than that of joining at the one-end sides. In the case where a great load is exerted as an impact-like force on the inner bag 13 of the respective water bags 12*a* to 12*c*, the respective sheets 25*a* and 25*b* are more readily separated at the flanges 26 on their other-end sides than on their one-end sides.

In order to vary the strength of joining at the one-end side and at the other-end side of the respective sheets 25*a*, 25*b*, control is made, in the case of thermal welding, by the welding time, welding temperature and pressure on welding and, in the case of a bonding agent, by the use of those bonding agents of different bonding strengths.

The respective partition member 25 is so dimensioned as to be smaller than the width dimension of the water bags 12*a* to 12*c*. By doing so, passages 13*b* are formed at both the longitudinal-direction end sides of the partition members 25 to allow a liquid L to flow in the water bags 12*a* to 12*c*. Since the respective partition member 25 is hollow, its inside space provides a passage 13*c* through which the liquid L flows.

The presence of the partition members 25 in the water bags 12*a* to 12*c* prevents the liquid L therein from excessively flowing in one direction only. Even if, for example, the water bags 12*a* to 12*c* are excessively compressed on one width-direction side, an expansion on the other width-direction side is restricted by the partition members 25.

Of the three water bags 12*a* to 12*c*, the water bag 12*b* is located in the longitudinal middle area and is harder than the other water bags 12*a* and 12*c* so that it can support the buttocks of a mattress user.

Making the water bag 12b harder than the other water bags can be achieved by increasing the viscosity of the liquid L in that water bag 12b or increasing a pressure therein. As another means, though not being shown, a plurality of water bags smaller in length than the water bag 12c can be arranged in a side-by-side way to achieve this.

As shown in FIG. 5, a non-woven fabric bag 17b containing a second internal liquid absorbing member 18 is fixed between the outer bottom of the inner bag 13 and the inner bottom of the outer bag 14 by means of a two-sided bonding tape 19. As the first internal liquid absorbing member 50 and second internal liquid absorbing member 18, use may be made of a high liquid absorbing resin in the form of powder, such as an acrylic acid-vinyl alcohol copolymer or sodium acrylate containing copolymer or a sheet-like member with its resin powder bound in the non-woven fabric.

When the liquid L in the inner bag 13 leaks into the outer bag 14 due to a breakage and degradation of the inner bag 13 in the water bags 12a to 12c, the liquid L is absorbed by the second internal liquid absorbing member 18, thus preventing it from flowing out of the outer bag 14. When the outer bag 14 is broken, the liquid L leaks from the outer bag 14 into the receiving section 11 so that it is absorbed by the first internal liquid absorbing member 50.

Though the first and second internal liquid absorbing members 50 and 18, absorbing the liquid L, are broken into ball-like pieces (in a non-bonded state), they are received within the non-woven fabric bags 17a and 17b, thus preventing these ball-like pieces from being spread apart.

The inner bag 13 is made of a transparent material and the outer bag 14 is made of a transparent material. By doing so, if the liquid L inside so leaks due to the breakage of the inner bag 13, this state can be checked from outside. Even if the water bags 12a to 12c are so made as to have a double layer structure of the inner and outer bags 13 and 14, that is, made so that it is hard for the liquid L to leak outside, it is possible to externally check the state of leaking of the liquid L out of the inner bag 13 through the transparent outer bag 14.

Figure 3A:
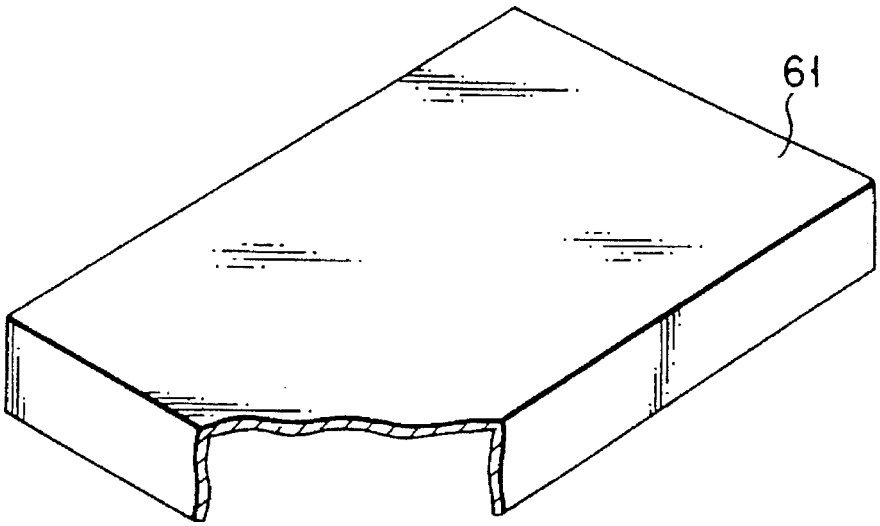
FIG. 3A is a perspective view showing a top sheet in the apparatus.

The upper surface side of the case 8 is covered with a top sheet 61 formed of a water-proof sheet, such as a polyethylene film or a vinyl film. The top sheet 61 is so formed as to have a box-like configuration with a bottom side opened as shown in FIG. 3A.

The top sheet 61 covers the upper opening of the receiving section 11 and outer peripheral surface of the case 8 as shown in FIG. 1. A first external liquid absorbing member 62a is formed as a sheet-like member on the upper surface (outer surface) of the top sheet 61 as shown in FIG. 3C.

A stacked unit comprising the spring unit 1 and case 8 is covered with an outer layer unit 21. The outer layer unit 21 comprises, as shown in FIG. 1, a lower layer section 22a covering the lower surface of the spring unit 1, a side cloth 22b covering the outer peripheral surface of the outer layer unit, and an upper layer section 22c covering the upper surface of the outer layer unit. The lower end portion of the side cloth 22b is sewed by a tape 23a on the outer marginal portion of the lower layer section 22a and the upper end portion thereof is sewed by a tape 23b on the outer marginal portion of the upper layer section 22c.

A fastener 24 is provided at the upper portion of the side cloth 22b around the full length of, or on at least three sides of, the outer peripheral portion of the side cloth so that the upper layer section 22c can be freely opened. Consequently, with the upper layer section 22c opened, the water bag 12 in the case 8 can be readily checked or replaced.

Figure 3B:
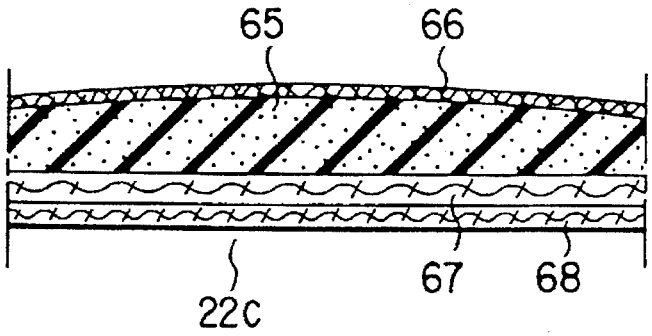
FIG. 3B is an enlarged view, partly in cross-section, showing part of an upper layer section of an outer layer unit in the apparatus.
Figure 3C:
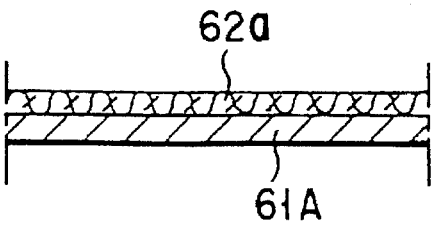
FIG. 3C is an enlarged view, partly in cross-section, showing the top sheet.

The upper layer section 22c has a sheet-like elastic member 65 of, for example, an urethane foam with an outer surface covered with a cloth 66 as shown in FIG. 3B and a second sheet-like external liquid absorbing member 67 and germ-/mildew-proof sheet 68 are sequentially fixed, in a stacking relation, to the inner surface of the sheet-like elastic member 65.

As the construction of the upper layer section 22c, a non-woven fabric and germ-/mildew-proof sheet may be sequentially joined to the inner surface of the fabric, though not shown, the non-woven fabric being bound with sweat absorbing cotton, germ-/mildew-proof urethane foam and liquid absorbing agent.

As the first and second external liquid absorbing members 62a and 67, like the first and second internal liquid absorbing members 50 and 18, use may be made of a high liquid absorbing resin in the form of powder, such as an acrylic acid-vinyl alcohol copolymer or sodium acrylate containing copolymer or a sheet-like member with its resin powder bound in the non-woven fabric. The first external liquid-absorbing member 62a provides a unit integral with the top sheet 61 through thermal welding.

The first external liquid absorbing member 62a is provided over the outer surface of the top sheet 61 to absorb the liquid L tending to flow outside from the receiving section 11. The second external liquid absorbing member 67 is provided at the upper layer section 22c of the outer layer unit 21 to absorb sweat of the user, a moisture content in the ambient atmosphere, etc. passed through the upper layer section 22c. By doing so, the second external liquid absorbing member, together with the first external liquid absorbing member 62a, prevents dews from being formed on the upper surface of the top sheet 61.

The planar-array heaters 30 are arranged in four arrays, as shown in FIG. 2, along the width-direction of the receiving section 11. The planar heaters 30a on both the sides have a length corresponding to the full length of the receiving section 11, that is, a length corresponding to three water bags 12a to 12c. The two inside planar heaters each are separated as a second planar heater unit 30b of a length corresponding to the first and second water bags 12a and 12b and third planar heater 30c of a length corresponding to a third planar water bag 12c.

The planar heaters 30a to 30c are heat controlled by a control unit 41. That is, thermistors 42a to 42c are provided at the receiving section 11 as shown in FIG. 2 to detect the temperatures of the first to the third water bags 12a to 12c. The detection signals of the respective thermistors 42a to 42c are input to the control unit 41. The control unit 41 calculates an average value of detection temperatures of the three thermistors 42a to 42c and heat-controls the planar heater 30c so as to obtain a temperature higher than the average value by 2° to 3° C.

The temperatures of the first and second planar heaters 30a and 30b can be set by a setting section (not shown) in the control unit 41. If, therefore, the first and second planar heaters 30a and 30b are set by the control unit 41 to a predetermined temperature, for example, 33° C., the third planar heater 30c is automatically set to a temperature higher than the first and second planar heaters 30a and 30b by 2° to 3° C.

The liquid L contained in the first to third water bags 12a to 12c is heated to a temperature substantially equal to the set temperatures of the respective heaters 30a to 30c . Consequently, if the first and second planar heaters 30a and 30b are set to 33° C., then the third planar heater 30c is temperature-controlled to 35° to 36° C.

The first and second planar heaters 30*a* and 30*b* control the temperatures of the liquids L of the first and second water bags 12*a* and 12*b* and the third planar heater 12*c* controls the temperature of the liquid L in the third water bag 12*c*. Due to the independent arrangement of the respective water bags 12*a* to 12*c*, there is less heat conduction among them. Therefore, temperature control can be so effected that the liquid L of the third water bag 12*c* is made higher in temperature than the liquids L of the first and second water bags 12*a* and 12*b* by 2° to 3° C.

In this way, since the liquid L in the third water bag 12*c* can be so controlled as to be made higher in temperature than the liquids L of the other water bags, the user can have his or her feet more highly warmed than the rest of his or her body by 2° to 3° C. while lying on the water mattress apparatus M in a supine position with his or her feet extending toward the third water bag 12*c* side. It is, therefore, possible for the user to lie or sleep on the mattress apparatus comfortably.

Further, the liquid L of the third water bag 12*c* is warmed not only by the planar heater 30*c* but also by the first planar heater 30*a*. Since the heat capacity of the water bag 12*c* is great and, in addition, the wafer bag 12*c* has a temperature difference of as high as 2° to 3° C. compared with the remaining water bags, the liquid L in the third water bag 12*c* can be controlled to a predetermined temperature by controlling the third planar heater 30*c* only.

According to the water mattress apparatus M thus arranged, if the inner and outer bags 13 and 14, for example, in one of the three water bags 12*a* to 12*c* are damaged for some reason or other, while the user is lying on the upper layer section of the outer layer unit, so that the liquid L leaks, then the liquid L is absorbed by the first internal liquid absorbing member 50 provided between the inner bag 13 and the outer bag 14.

In the case where the liquid L leaks outside the outer bag 14 without being absorbed by the first internal liquid absorbing member 50, it is absorbed by the second liquid absorbing member 18 provided on the bottom sheet 10 of the receiving section 11. Therefore, there is almost no risk that the liquid L, even if leaking out of the water bags 12*a* to 12*c*, will flow outside of the receiving section 11.

In the cases where there occurs sudden leakage of the liquid L out of the water bags 12*a* to 12*c* or, for example, the user continues using the mattress apparatus without noticing such leakage of the liquid L, the liquid L will tend to flow outside from the receiving section 11.

Since, however, the upper side of the receiving section 11 is covered with the top sheet 61, the liquid L tending to flow outside from the receiving section 11 is prevented by the top sheet 61 from flowing outside from the receiving section 11.

On the other hand, the sweat of the user on the mattress apparatus M in the supine position, as well as the moisture content in the atmosphere and so on, enters the upper layer section 22*c* of the outer layer unit 21. The moisture content entering the upper layer section 22*c* is absorbed by the second external liquid absorbing member 67 situated on the lower side and, if being not absorbed by the second external liquid absorbing member 67, absorbed by the first external liquid absorbing member 62*a* situated on the upper side of the top sheet 61.

The moisture content absorbed by the second external liquid absorbing member 67 and first external liquid absorbing member 62*b* are accumulated in the absorbing member. For this reason, there is no possibility that the sweat of the user entering into the upper layer section 22*c*, atmospheric humidity, etc., will be accumulated in the form of dew on the top sheet 61 and absorbed in the upper layer section 22*c*. Further, there is hardly any possibility either that such sweat and moisture will be trapped in the upper layer section 22*c*. It is, therefore, possible to prevent trapping of humidity in the upper layer section 22 and formation of dew on the top sheet 61 and, for the user, to use the mattress apparatus in a very comfortable way.

Further, the moisture or water content, once being absorbed in the liquid absorbing material, does not flow or flow back whereby it is possible to prevent the upper layer section 22*c* from being moistened and the dew from being deposited on the upper surface of the top sheet 61.

Since the germ-mildew-proof sheet 68 is provided at the inner surface of the upper layer section 22*c*, it is possible to prevent the growth of mildew on the outer surface of the top sheet 61 and on the upper layer section 22 as well as the multiplication of germs. Thus the water mattress apparatus M can be used in a sanitary way.

A great shock may sometimes be applied to the water bags 12*a* to 12*c* of the mattress apparatus M, for example, in the case where the user jumps up onto the bed. Since, in such a case, the liquid L in the respective water bag is forced to move suddenly, a tension acts upon the partition members 25 in the inner bag 13 situated on the flowing side (the expansion side of the inner bag 13) of the liquid L.

The partition members 25 each are divided into the upper sheet 25*a* and lower sheet 25*b* with both their one and other end sides fixed with different fixing strengths. That is, the respective sheets 25*a* and 25*b* are more strongly fixed at their one end sides to the inner surface of the inner bag 13 than at their other end sides to each other.

If, therefore, a greater tension force acts on the partition member 25 than an ordinary state of use, the sheets 25*a* and 25*b* are separated apart at their mutually fixed other end sides. As a result, no excessive tension force acts on the inner bag 13 to which the one end sides of the sheets 25*a* and 25*b* are fixed. It is, therefore, possible to prevent the inner bag 13 from being broken by being stretched by the partition member 25.

On the other hand, the spring unit 1 is comprised of a plurality of continuous springs 2 with the adjacent coil portions 3 formed continuously. This structure is less subject to compressive deformation by a load at one portion involved, that is, at a specific coil portion and the plurality of coil portions 3 are subject to elastic deformation resulting from a load there. That is, there is a smooth deformation against the load. For this reason, the water bags 12*a* to 12*b* over the spring unit 1 are also prevented from being partly greatly deformed, such as being bent against a load, thus not impairing performance of the water mattress apparatus M.

Figure 8:
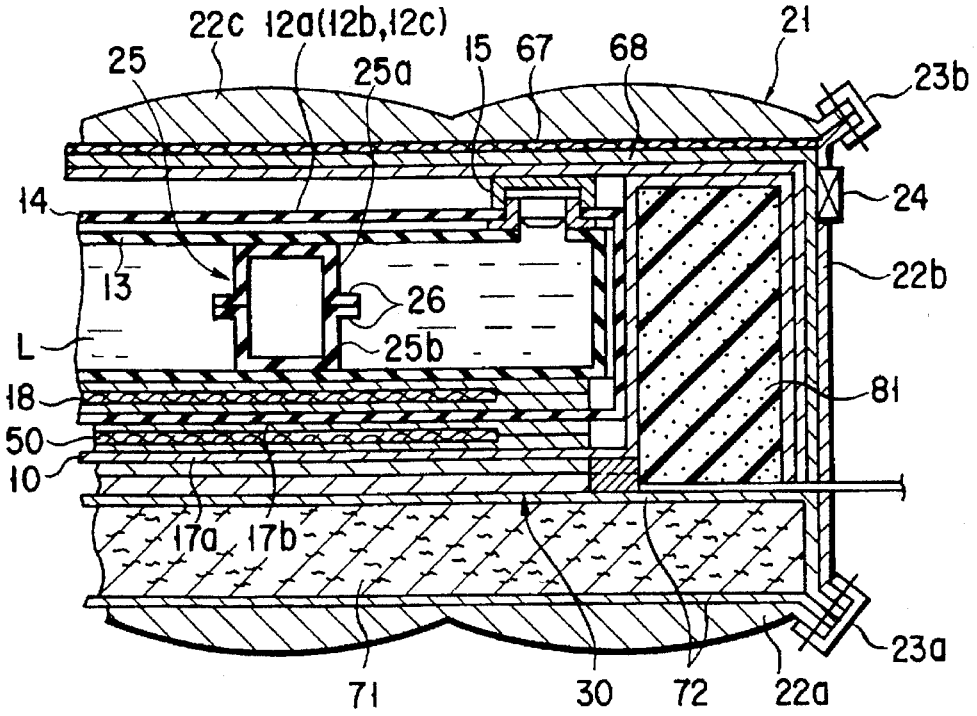
FIG. 8 is a view, partly in cross-section, showing a water mattress apparatus according to a second embodiment of the present invention.

FIG. 8 shows a second embodiment of the present invention. In place of the spring unit 1 as a cushion body, use is made, in the second embodiment, of an elastic plate 71 of a given thickness formed of, for example, an urethane foam. As the elastic plate 71 use may be made of not only the urethane foam but also a breathable fiber cushion, such as polyester cotton with a germ-/mildew-proof chemical agent deposited therein.

The upper and lower surfaces of the elastic plate 71 are covered with a sheet 72, such as a non-woven fabric, so as to prevent the elastic plate 71 from being damaged due to a frictional force acting thereon. The outer peripheral portion of the sheet 72, together with a side cloth 22*b* and lower layer section of an outer layer unit 21, is sewed together by a tape 23*a*.

This structure prevents the elastic plate 71 and case 81 from being displaced relative to each other.

The case 81 made of an elastic material, such as a urethane foam, is so made as to have a rectangular frame-like configuration. The case 81 has its hardness so set that, even if water bags 12*a* to 12*c* contained into the frame-like case are deformed to cause its inner wall surface to be pushed outwardly, the case 81 is less subject to that pushing force. Further, a bottom sheet 10 covers the inner wall surface, upper surface and outer peripheral surface of the case 81.

In the second embodiment, the same reference numerals are employed to designate parts or elements corresponding to those shown in the first embodiment and any further explanation is, therefore, omitted.

Figure 9:
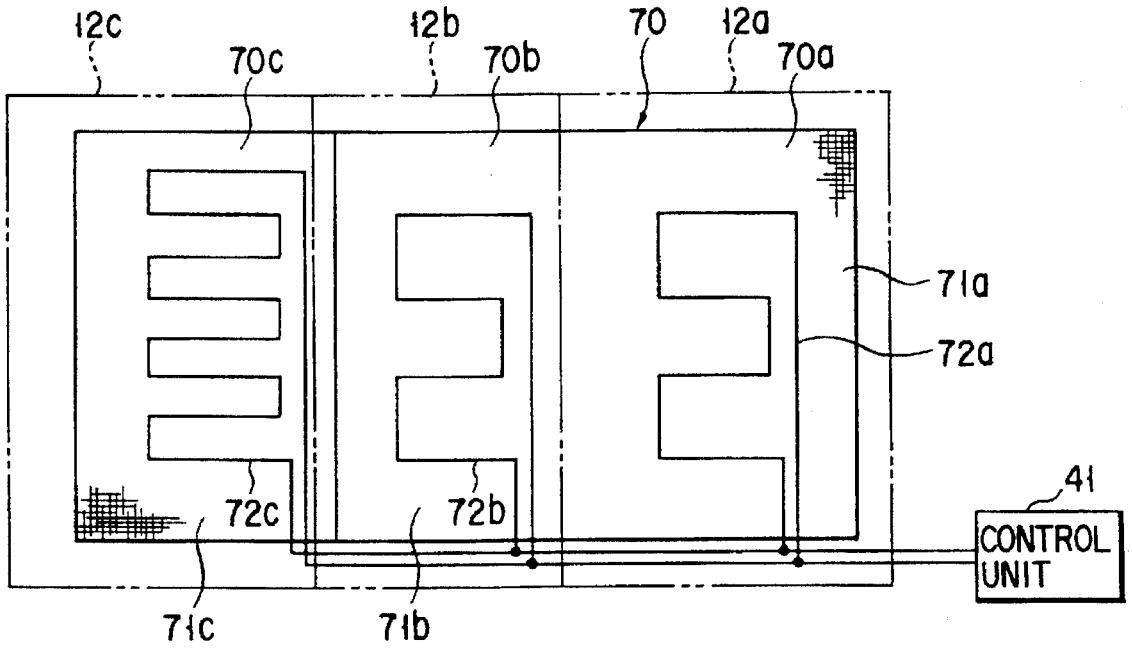
FIG. 9 is a schematic view showing control means for controlling temperature in the liquid of a water bag in a third embodiment of the present invention.

FIG. 9 shows a third embodiment of the present invention. The third embodiment constitutes a variant of the planar-array heater. That is, the planar-array heater unit 70 is separated into first to third planar heaters 70*a* to 70*c* corresponding to water bags 12*a* to 12*c*. The respective planar heaters 70*a* to 70*c* are comprised of heat generating lines 72*a* to 72*c* embedded in corresponding sheets 71*a* to 71*c*. The heat generating line 72*c* of the third planar heater 70*c* is so set as to be longer than the heat generating lines of the other planar heaters. That is, the third planar heater 70*c* is so set as to be greater in heating value than the other planar heaters.

If the respective planar heaters 70*a* to 70*c* conduct through a control unit 41, then the third planar heater 70*c* having a longer heat generating line 72*c* generates heat at a higher temperature than the other planar heaters 70*a* and 70*b*. By the proper choice of their length it is possible, as in the case of the first embodiment, to heat a liquid L in the third water bag 12*c* to a temperature higher than those in liquids L of the first and second water bags 12*a* and 12*b* by 2° to 3° C.

Figure 10:
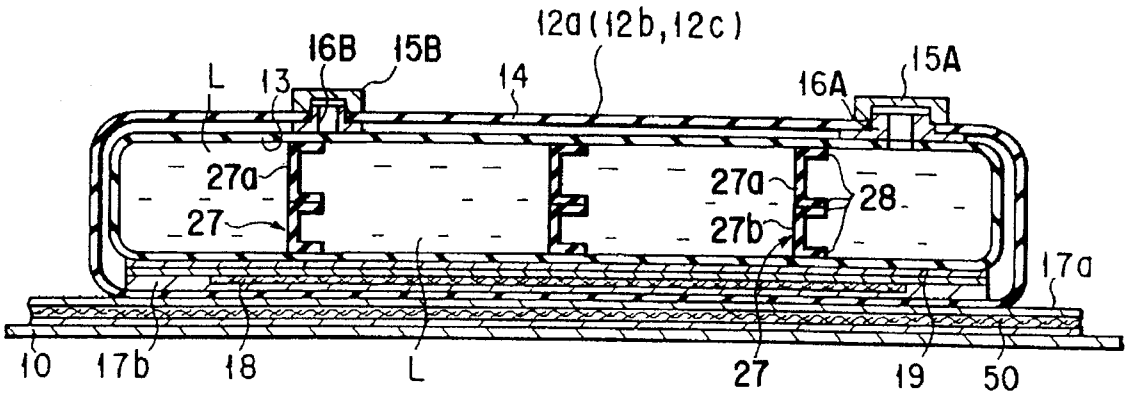
FIG. 10 is a cross-sectional view showing a water bag in a fourth embodiment of the present invention.

FIG. 10 shows a fourth embodiment of the present invention. This embodiment constitutes a variant of partition members provided in water bags 12*a* to 12*c*. That is, the partition member 27 in the fourth embodiment, like the embodiment shown in FIG. 5, is divided into an upper sheet 27*a* and lower sheet 27*b*. The respective sheets 27*a* and 27*b* are L-bent at their one end portions and at their other end portions to provide flanges 28.

The flanges 28 on the one-end sides of the respective sheets 27*a* and 27*b* are fixed to inner upper and lower surface of an inner bag 13 and the flanges on the opposed other end sides of the respective sheets 27*a* and 27*b* are fixed to each other. Even in this embodiment, the fixing of the flanges is more strongly achieved at the one end sides than at the other end sides of the respective sheets 27*a* and 27*b* as in the first embodiment, whereby, when an impact is exerted on the water bags 12*a* to 12*c*, the other end sides of the respective sheets 27*a* and 27*b* of the partition member are separated off the corresponding surface instead of being separated at the one end sides thereof.

Figure 11:
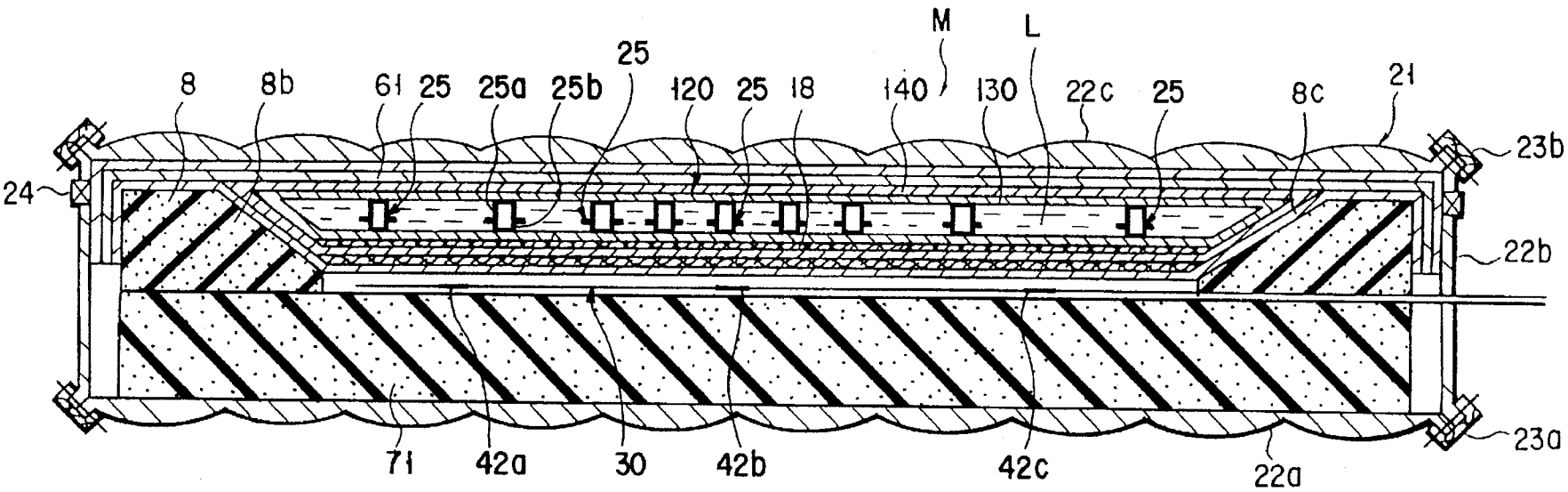
FIG. 11 is a cross-sectional view showing a fifth embodiment of the present invention.

FIG. 11 shows a fifth embodiment of the present invention. In this embodiment, use is made of an elastic plate 71 of a given thickness, such as an urethane foam, serving also as a base plate 8*a* shown in the first embodiment. The elastic plate 71 is thicker than the base plate 8*a* and has a cushioning property. As the elastic plate 71 use may be made of not only the urethane foam but also a breathable fiber cushion, such as a polyester cotton with a germ-/mildew-proof chemical agent deposited therein.

A frame section 8*b* forming a case 8 is fixed in a stacking relation to the upper surface of the elastic plate 71. One water bag 120 substantially equal in size to a receiving section 11 of the case 8 is placed and received in the receiving section 11 of the case 8.

The water bag 120 is so formed as to have a double-layer structure having an inner bag 130 and outer bag 140. As in the first embodiment, partition members 25 are provided in the inner bag 130 and each is divided into an upper sheet 25*a* and lower sheet 25*b*.

In a longitudinal direction of the water bag 120 the partition members are arranged more densely, that is, at narrower intervals, at a middle portion than at the remaining portion. By doing so, the flow resistance of the liquid L in the water bag 120 is greater in the longitudinal middle portion than in the longitudinal end portions and there occurs less deformation on application of load. That is, according to the water bag 120 so formed, the longitudinal middle portion is made harder than each remaining end portion, thus preventing the buttocks of the user from deeply sinking.

In the fifth embodiment, the elastic plate 71 may be made substantially equal in thickness to the base plate 8*a* and a spring unit 1 as shown in the first embodiment may be stacked on that lower surface side to provide a cushioning characteristic.

In the fifth embodiment, the same reference numerals are employed to designate parts or elements corresponding to those shown in the first embodiment and in the second embodiment shown in FIG. 8 and any further explanation is, therefore, omitted.

EFFECTS OF THE INVENTION

According to the invention, since the case is supported by a cushion body, a water bag unit is obtained with a cushion characteristic added thereto by the cushion body.

According to the second aspect of the present invention, among a plurality of separate water bags, that water bag situated on the "feet" side of the user can have its liquid warmed to a temperature higher than those of the remaining water bags so that the user can enjoy a comfortable sleep on the resultant mattress apparatus.

According to the third aspect of the present invention a liquid leaking from the water bag into a receiving section of the case is absorbed by an internal liquid absorbing means so that the liquid is prevented from flowing outside from the case.

According to the fourth aspect of the present invention, a water bag is so formed as to have a double-layered structure comprised of an inner bag and outer bag. This structure is less subject to breakage at the inner bag containing a liquid and, even if the inner bag is broken and the liquid leaks out of the broken inner bag, it is absorbed by a liquid absorbing member placed between the inner bag and the outer bag and does not leak out.

According to the fifth aspect of the present invention when a greater impact force is exerted on a water bag body than in an ordinary state of use, earlier separation occurs at the fixed area between an upper sheet and a lower sheet of a partition member than at the fixed area between the bag and the sheet and, even if a great impact force is applied to the bag, the bag is prevented by the partition member from being torn. It is, therefore, possible to prevent leakage of the liquid.

We claim:

1. A water mattress apparatus comprising:

a cushion unit which is subjected to elastic compressive deformation on application of a load thereon; a case having an upper surface and lower surface with a receiving section having an opening at the upper surface of the case, said case being joined at the lower surface thereof to an upper surface of the cushion unit in stacked relation;

a water bag formed from a flexible water-proof sheet and held in the receiving section with a liquid contained in the water bag;

said water bag having a double-layered structure including an inner bag with the liquid contained therein, an outer bag over the inner bag, band-like partition members connecting together inner upper and inner lower surfaces of the inner bag, and a liquid absorbing member provided between the inner bag and the outer bag to absorb liquid leaking out of the inner bag;

said band-like partition members each having an upper sheet fixed at one end to the inner upper surface of the bag, and a lower sheet fixed at one end to the inner lower surface of the bag, and the other end of the lower sheet being fixed to the other end of the upper sheet, and wherein a strength of fixing of said band-like partition members is so set to be lower at said other end sides of the upper and lower sheets thereof than at said one end sides of the upper and lower sheets thereof; and an outer layer unit covering the stacked cushion and case.

2. The water mattress apparatus according to claim 1, wherein the lower surface of the case is adhesively bonded to the upper surface of the cushion unit.

3. The water mattress apparatus according to claim 1, wherein the outer bag is made of a transparent material.

4. The water mattress apparatus according to claim 1, wherein the case is made of an elastic material which is subject to elastic compressive deformation on application of a load thereon.

5. The water mattress apparatus according to claim 1, wherein the cushion unit comprises a plurality of continuous springs arranged in a side-by-side relation, each spring having a plurality of coil portions comprised of one wire and arranged in one array.

6. The water mattress apparatus according to claim 1, wherein the water bag comprises a plurality of separate water bags arranged side by side along a longitudinal direction of the case.

7. The water mattress apparatus according to claim 6, wherein the separate water bags include a middle water bag which is located at a longitudinal middle portion of the case and which is harder than remaining water bags of the separate water bags.

8. A water bag, comprising:

a bag formed of a flexible water-proof sheet material and containing a liquid therein, said flexible water-proof sheet material providing a liquid-tight structure for the liquid; and partition members comprised of an upper sheet fixed at one end to an inner upper surface of the bag, and a lower sheet fixed at one end to an inner lower surface of the bag, and the other end of the lower sheet being fixed to the other end of the upper sheet, and wherein a strength of fixing of the partition members is so set to be lower at said other end sides of the sheets than at said one end sides of the sheets; and wherein the respective sheets are bent at intermediate areas thereof into two portions, the two intermediate bent portions constituting said one end sides and both end portions of the two intermediate portions constituting said other end sides.

9. The water bag according to claim 8, wherein the fixing of the bag and one end side of the respective sheets and that of the other end sides of the sheets is achieved by thermal welding.

10. The water bag according to claim 8, wherein the fixing of the bag and one end side of the respective sheets and that of the other end sides of the sheets is achieved by a bonding agent.

11. The water bag according to claim 8, wherein the bag has a double layer structure comprising:

an inner bag containing the liquid therein and the partition members provided therein; and an outer bag containing the inner bag therein.

12. The water bag according to claim 11, wherein the outer bag is made of a transparent material.

13. The water bag according to claim 11, wherein a liquid absorbing member is provided between the inner bag and the outer bag to absorb liquid leaking out of the inner bag.

14. The water bag according to claim 13, wherein the liquid absorbing member is provided between an outer bottom surface of the inner bag and an inner bottom surface of the outer bag.

* * * * *